US010815451B2

(12) United States Patent
Schmaelzle et al.

(10) Patent No.: US 10,815,451 B2
(45) Date of Patent: Oct. 27, 2020

(54) AUTOMATIC DISHWASHING COMPOSITION

(71) Applicant: Reckitt Benckiser (Brands) Limited, Slough (GB)

(72) Inventors: Claudia Schmaelzle, Heidelberg (DE); Pavlinka Roy, Heidelberg (DE)

(73) Assignee: RECKITT BENCKISER (BRANDS) LIMITED, Slough (GB)

( * ) Notice: Subject to any disclaimer, the term of this patent is extended or adjusted under 35 U.S.C. 154(b) by 289 days.

(21) Appl. No.: 15/314,656

(22) PCT Filed: Jun. 1, 2015

(86) PCT No.: PCT/GB2015/051596
§ 371 (c)(1),
(2) Date: Nov. 29, 2016

(87) PCT Pub. No.: WO2015/181571
PCT Pub. Date: Dec. 3, 2015

(65) Prior Publication Data

US 2017/0191004 A1 Jul. 6, 2017

(30) Foreign Application Priority Data

May 30, 2014 (GB) ..... 1409631.7

(51) Int. Cl.

| | |
|---|---|
| ***C11D 1/00*** | (2006.01) |
| ***C11D 3/37*** | (2006.01) |
| ***C11D 3/00*** | (2006.01) |
| ***C11D 17/04*** | (2006.01) |
| ***C11D 11/00*** | (2006.01) |
| ***C11D 17/00*** | (2006.01) |
| ***A47L 15/00*** | (2006.01) |

(52) U.S. Cl.
CPC ..... *C11D 3/3723* (2013.01); *A47L 15/0007* (2013.01); *C11D 3/0073* (2013.01); *C11D 11/0035* (2013.01); *C11D 17/0004* (2013.01); *C11D 17/043* (2013.01); *C11D 17/045* (2013.01)

(58) Field of Classification Search
None
See application file for complete search history.

(56) References Cited

U.S. PATENT DOCUMENTS

| | | | | |
|---|---|---|---|---|
| 2009/0124528 | A1 | 5/2009 | Danziger et al. | |
| 2013/0102516 | A1 | 4/2013 | Hueffer et al. | |
| 2018/0127692 | A1* | 5/2018 | Coope-Epstein .... | C11D 17/044 |
| 2018/0201876 | A1* | 7/2018 | Garcia Marcos ..... | C11D 1/721 |

FOREIGN PATENT DOCUMENTS

| | | | |
|---|---|---|---|
| CA | 2849358 | A1 | 4/2013 |
| WO | 99/07815 | A1 | 2/1999 |
| WO | 99/07816 | A1 | 2/1999 |
| WO | 03/033636 | A1 | 4/2003 |
| WO | 2010/020765 | A1 | 2/2010 |
| WO | 2012/153143 | A2 | 11/2012 |
| WO | 2013/124784 | A1 | 8/2013 |
| WO | 2014/005933 | A1 | 1/2014 |

OTHER PUBLICATIONS

International Search Report for related International Patent Application No. PCT/GB2015/051596 dated Sep. 2, 2015.
Written Opinion of the International Searching Authority for related International Patent Application No. PCT/GB2015/051596 dated Sep. 2, 2015.
Combined Search and Examination Report for related GB Patent Application No. 1409631.7 dated Nov. 28, 2014.

* cited by examiner

*Primary Examiner* — Necholus Ogden, Jr.
(74) *Attorney, Agent, or Firm* — Troutman Pepper Hamilton Sanders LLP; Ryan A. Schneider; Chris N. Davis

(57) ABSTRACT

The present invention relates to an improved detergent composition for use in the protection of non-metallic inorganic materials such as glassware in automatic ware washing machines.

20 Claims, No Drawings

AUTOMATIC DISHWASHING COMPOSITION

TECHNICAL FIELD

The present invention relates to an improved composition for use in the protection of non-metallic inorganic materials such as glassware in an automatic dishwashing (ADW) process.

BACKGROUND

The problem of corrosion of non-metallic inorganic items, such as glassware, ceramic and enamel materials, when subjected to automatic dishwashing processes is well recognised in the art. For example, it has been proposed that the problem of glassware corrosion is the result of two separate phenomena. Firstly, it has been suggested that the corrosion is due to leakage of minerals from the glass network, accompanied by hydrolysis of the silicate network. Secondly, it is proposed that the silicate material is then released from the glass.

These phenomena can cause damage to glassware after a number of separate wash cycles. The damage may include cloudiness, scratches, streaks and other discoloration/detrimental effects. The damage is generally irreversible and over time can be detected as a loss in mass of the glassware. This is in contrast to the cloudiness, streaks or spotting that may result from deposition of substances on the surface of the glassware, which can appear after a single wash cycle, and is generally removable.

Silicate materials have been proposed as agents that are effective in preventing materials from being released by the glass composition. However, the use of silicate compounds can have detrimental side effects, such as the tendency to increase separation of silicate material at the glass surface.

A further solution has been to use metals such as zinc, either in metallic form (such as described in U.S. Pat. No. 3,677,820) or in the form of compounds. The use of soluble zinc compounds in the prevention of glassware corrosion in a dishwasher is described in, for example, U.S. Pat. No. 3,255,117.

European Patents; EP-A-0 383 480, EP-A-0 383 482 and EP-A-0 387 997) describe the use of water insoluble compounds including zinc silicate, zinc carbonate, basic zinc carbonate ($Zn_2(OH)_2CO_3$), zinc hydroxide, zinc oxalate, zinc monophosphate ($Zn_3(PO_4)_2$) and zinc pyrophosphate ($Zn_2P_2O_7$) for this purpose.

However, it has been found that the use of heavy metal compounds in some circumstances reduce the bleaching performance of a dishwashing composition on bleachable stains such as tea stains. Furthermore, for environmental reasons, it is becoming increasingly desirable to limit (and especially to avoid) the use of heavy metals in detergent formulations.

WO2010/020765 proposed a solution to this problem of glass and tableware erosion that did not require the use of heavy metals. This document, which is hereby incorporated by reference, disclosed that polyalkyleneimines such as polyethyleneimine (PEI) were highly effective additives for the prevention of corrosion of non-metallic inorganic items in automatic washing machines. WO2012/153143 also discloses ADW compositions that contain PEI for inhibiting glassware corrosion.

WO 99/07815 discusses the use of PEI as a sequestrant in detergents, for the purpose of stain removal, preferably in laundry detergents that are substantially free of bleach. Aqueous liquid laundry detergents are amongst the compositions disclosed.

It has been increasingly found by the applicants that lower and lower amounts of PEI can be added to ADW detergent compositions whilst maintaining protection against glassware corrosion. PEI may be added in doses equivalent to between 1 to 10 mg per wash cycle, whilst still maintaining full glassware protecting performance.

Polyethyleneimines can be solid or liquid compounds at room temperature, depending on their structure. For the field of automatic dishwashing, a number of liquid PEIs are particularly of interest. However, it is extremely challenging to formulate a liquid form of PEI homogenously at very low levels into an automatic dishwashing detergent.

The applicants have found that applying low levels of PEI to solid powders or granules is difficult and can result in inconsistent distribution of the material throughout the solid. PEIs are strongly surface active and binding materials. This means that the levels of PEI can vary significantly from wash to wash in powdered detergent and other solid monodose formats, leading to inconsistent results when formulating such products on an industrial scale.

The applicants have found that a good way to reliably prepare low level PEI-containing ADW compositions is to formulate the PEI in a gel or liquid phase of the composition. In this way the PEI seems to be evenly distributed and available in wash conditions to protect glassware.

STATEMENTS OF INVENTION

In a first aspect of the invention there is provided an automatic dishwasher (ADW) detergent composition comprising less than 1% by weight of a Polyethylene imine (PEI) wherein the PEI is contained within a gel or liquid phase of the ADW detergent composition.

In a second aspect of the invention, there is provided a composition comprising less than 1% by weight of a PEI wherein the PEI is contained within a gel or liquid phase of the ADW detergent composition.

In a third aspect of the invention, there is provided a product comprising the composition according to the invention in its first or second aspect, housed within a water soluble or water dispersible film or container.

In a fourth aspect of the invention, there is provided a method of automatic dishwashing, comprising supplying a composition according to the invention in its first or second aspect, or a product according to the invention in its third aspect, to an automatic dishwasher, and releasing the composition or product into a wash cycle of the automatic dishwasher.

In a fifth aspect of the invention, there is provided the use of a composition according to the invention in its first or second aspect, or a product according to the invention in its third aspect, for cleaning glassware whilst inhibiting the corrosion of the glassware during automatic dishwashing.

DETAILED DESCRIPTION

In the following section, embodiments discussed apply equally to all aspects of the invention unless the context dictates otherwise. Amounts quoted are by weight (wt %) unless stated otherwise.

Herein, term "phase" is preferably not interpreted in the strict thermodynamic sense. For example, the liquid "phase" may also comprise suspended solids, i.e. it may be a suspension or paste. Preferably, it is homogeneous on the macroscopic scale and/or is spatially separated from any other "phases" present.

For the purposes of the present invention, gel form is preferred. Herein, the term gel is not limited to a strictly colloidal composition. For the purposes of the present invention, gel may be considered to be a thickened liquid.

When a less viscous gel precursor material is used for processing ease, it preferably becomes more viscous, and preferably sets to become shape-stable, on standing.

In this embodiment, the gel precursor is preferably already gel itself, suitably a viscous material but flowable, either under gravity or when pumped. Preferably its viscosity when introduced is at least 1,000 mPa·s., preferably at least 5,000 mPa·s., preferably at least 10,000 mPa·s., measured at 25° C. on a Brookfield viscometer, RVDV-II+, spindle no. 27, speed 2.5 rpm.

Product Format

The entire ADW composition does not need to be in liquid or gel form, although it may be. The ADW composition may be comprised of several different phases, at least one of which may be in a liquid or gel form, provided that the liquid or gel form contains PEI. Detergent phases in the prior art include tablets, powders, gels, pastes and liquids. The detergent compositions of the present invention may comprise a mixture of two or more phases as long as at least one is a gel or liquid phase. For example the composition may comprise a gel or liquid component and a free powder component. The PEI may be entirely contained within the gel or liquid portion, or contained within both portions.

In an embodiment, the ADW detergent composition is a multi-phase composition with at least two or more separate phases, preferably at least three or more separate phases. In an embodiment, the composition comprises one or more different phases including powder, granules, and compressed solids.

Preferably the ADW compositions of the present invention are monodose compositions, i.e. compositions pre-supplied in the quantity required for a single wash cycle.

The monodose composition may comprise a tablet with a gel portion or layer. If compressed tablets form a portion of the ADW detergent composition, they may be homogeneous or composed of multi-layers. If the tablets are multi-layered then different layers may comprise different parts of the detergent composition. This may be done to increase stability or increase performance, or both.

In an embodiment, the composition is contained within a water soluble film or container, preferably a polyvinylalcohol film or container. The ADW detergent compositions may be housed in PVOH rigid capsules or film blisters. These PVOH capsules or blisters may have a single compartment or may be multi-compartment.

Multi-compartment blisters or capsules may have different portions of the composition in each compartment, or the same composition in each compartment. The distinct regions/compartments may contain any proportion of the total amount of ingredients as desired. The PVOH capsules or film blisters may be filled with tablets, powders, gels, pastes or liquids, or combinations of these, within the scope of the invention.

The monodose may comprise an injection moulded PVOH capsule with multiple compartments. Each compartment may comprise a different composition. At least one of the compartments will contain a gel or liquid composition and at least a portion of the PEI will be in this composition and preferably all of the PEI will be in this composition.

Polyethyleneimine

The polyethyleneimine (PEI) is contained within a gel or liquid phase of the composition, and the amount of the polyethyleneimine is less than 1% by weight of the composition. Preferably, where the composition is multi-phase, the polyethyleneimine is only present in the gel or liquid phase.

Preferably the lowest amount of PEI to achieve effective results will be used. In an embodiment, the PEI comprises less than 0.5% by weight of the composition, preferably less than 0.25% by weight of the composition and most preferably less than 0.05%. Preferably, the PEI comprises less than 0.005% and preferably less than 0.0025% by weight of the composition. In an embodiment, the PEI loading is less than 0.0005% by weight.

Preferably the amount of PEI used will be between 0.5 mg and 100 mg per wash, more preferably between 1 mg and 50 mg, more preferably between 2 mg and 25 mg, most preferably between 4 and 10 mg.

In an embodiment, the composition comprises at least 0.0001 wt % of the PEI and/or less than 0.5 wt %, less than 0.25 wt %, less than 0.05 wt %, less than 0.04 wt %, less than 0.03 wt %, less than 0.01 wt %, less than 0.005 wt %, or less than 0.0025 wt %, of the PEI.

While it has been found that the PEI used may have any formula weight for effectiveness, preferably the PEI has a lower formula weight. Preferably the PEI used in the present invention has a formula weight between 100 and 50,000, more preferably between 400 and 25,000, more preferably between 800 and 10,000 and most preferably between 1000 and 3000. In an embodiment, the PEI has a molecular weight between 100 and 2500, preferably 200 and 1500 and most preferably between 400 and 1200. In an embodiment, the molecular weight of the PEI is between 700 and 900. The most preferred PEI has a molecular weight of 800. The molecular weight is suitably determined by light scattering.

Any PEI may be used. The PEI may be branched or linear. Preferably, the PEI is branched. Preferably, it contains primary, secondary and tertiary amine groups, and preferably has a ratio of primary to secondary amine groups between 1:0.5 and 1:1, preferably between 1:0.7 and 1:0.9.

Preferably, the PEI is liquid at room temperature.

Preferably, the PEI contains no alkoxylate groups or is homopolymeric.

A particularly preferred PEI is Lupasol® FG which is supplied by BASF.

Solvent

Water may be included in the ADW detergent composition. Preferably, however, the gel or liquid phase comprising the PEI is non-aqueous. In an embodiment, the gel or liquid phase contains no more than 10%, no more than 5%, no more than 3%, no more than 1%, or no, water, by weight of the gel or liquid phase.

The gel or liquid phase may contain organic solvents, preferably water-miscible solvents.

Surfactant

Surfactant may also be included in the ADW detergent composition and any of nonionic, anionic, cationic, amphoteric or zwitterionic surface active agents or suitable mixtures thereof may be used. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred according to the present invention.

In the case of ADW compositions, it is preferred to minimise the amount of anionic surfactant. Preferably the composition comprises no more than 2 wt %, no more than 1 wt %, or no, anionic surfactant. Preferably the composition comprises no more than 4 wt %, no more than 2 wt %, no more than 1 wt %, or no, ionic surfactant of any type. Non-ionic surfactants are especially preferred instead for automatic dishwashing compositions.

A preferred class of non-ionic surfactants is ethoxylated non-ionic surfactants prepared by the reaction of a mono-hydroxy alkanol or alkylphenol with 6 to 20 carbon atoms. Preferably the surfactants have at least 12 moles, particularly preferred at least 16 moles, and still more preferred at least 20 moles, such as at least 25 moles, of ethylene oxide per mole of alcohol or alkylphenol.

Particularly preferred non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight, and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30% by weight, preferably more than 50% by weight, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5, and y is a value of at least 15.

Another group of preferred non-ionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$, H, methyl or ethyl is particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$= methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R_3)O]_xCH_2CH(OH)CH_2OR^2$$

The use of mixtures of different non-ionic surfactants is suitable in the context of the present invention, for instance mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the detergent composition in an amount of from 0.1% by weight to 20% by weight, more preferably 1% by weight to 15% by weight, such as 2% to 10% by weight, based on the total weight of the detergent composition.

In an embodiment, the gel or liquid phase comprising the PEI further comprises at least 10%, at least 15%, at least 20%, or at least 25%, surfactant, preferably non-ionic surfactant, by weight of the gel or liquid phase.

In an embodiment, a gel composition comprises between 30 and 80% non-ionic surfactants, 5-35% solvents, 0.1-5% and 0-10% water.

Builders

The detergent compositions may comprise a builder (or co-builder). In an embodiment, the liquid or gel phase comprises no builder. In an embodiment in which the composition is multi-phase, the builder is included in a separate phase from the PEI.

The builder/co-builder may be either a phosphorous-containing builder or a phosphorous-free builder as desired. In many jurisdictions, phosphate builders are banned. In an embodiment, the composition is phosphate-free.

If phosphorous-containing builders are to be used it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP). Conventional amounts of the phosphorous-containing builders may be used typically in the range of from 15% by weight to 60% by weight, such as from 20% by weight to 50% by weight or from 25% by weight to 40% by weight.

If phosphorous-free builder is included, it is preferably chosen from succinate based compounds. The terms 'succinate based compound' and 'succinic acid based compound' are used interchangeably herein. Conventional amounts of the succinate based compounds may be used, typically in the range of from 5% by weight to 80% by weight, such as from 15% by weight to 70% by weight or from 20% by weight to 60% by weight. The compounds may be used individually or as a mixture.

Other suitable builders are described in U.S. Pat. No. 6,426,229 which are incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula:

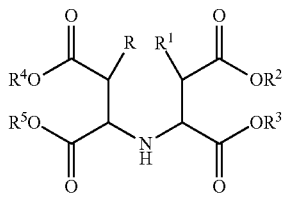

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6 R^7 R^8 R^9 N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms.

Preferred examples include tetrasodium imminosuccinate. Iminodisuccinic acid (IDS) and (hydroxy)iminodisuccinic acid (HIDS) and alkali metal salts or ammonium salts thereof are especially preferred succinate based builder salts.

The phosphorous-free co-builder may also or alternatively comprise non-polymeric organic molecules with carboxylic group(s). Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred phosphorous-free builder is sodium citrate. Such polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Such polycarboxylates which contain three carboxyl groups include, for example, water-soluble citrate. Correspondingly, a suitable hydroxycarboxylic acid is, for example, citric acid.

Three other highly preferred builders are MGDA, GLDA and malonyl lactate.

Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts. Secondary builders which are organic are preferred. A polymeric polycarboxylic acid is the homopolymer of acrylic acid. Other suitable secondary builders are disclosed in WO 95/01416, to the contents of which express reference is hereby made.

Preferably the total amount of builder present in the composition is at least 20% by weight, and most preferably at least 25% by weight, preferably in an amount of up to 70% by weight, preferably up to 60% by weight, more preferably up to 45% by weight. The actual amount used in the compositions will depend upon the nature of the builder used. If desired a combination of phosphorous-containing and phosphorous-free builders may be used.

Bleaches

The detergent compositions may comprise a bleach component or material. For example, the bleach material may comprise and oxygen or chlorine based bleach. The bleach material may be selected from any conventional bleach material known to be used in detergent compositions. The material may comprise the active bleach species itself or a precursor to that species. For example, the bleach material may comprise at least one inorganic peroxide or organic peracid or a chlorine based bleach including derivatives and salts thereof or mixtures thereof. Inorganic peroxides include percarbonates, perborates, persulphates, hydrogen peroxide and derivatives and salts thereof. The sodium and potassium salts of these inorganic peroxides are suitable, especially the sodium salts. Sodium percarbonate and sodium perborate are most preferred, especially sodium percarbonate.

The detergent compositions may also comprise bleach additives or bleach activation catalysts. The composition may preferably comprise one or more bleach activators or bleach catalysts depending upon the nature of the bleaching compound. Any suitable bleach activator may be included, for example TAED, if this is desired for the activation of the bleach material. Any suitable bleach catalyst may be used, for example manganese acetate or dinuclear manganese complexes such as those described in EP-A-1,741,774. The organic peracids such as perbenzoic acid and peroxycarboxylic acids e.g. PAP do not require the use of a bleach activator or catalyst as these bleaches are active at relatively low temperatures such as about 30° C. and this contributes to such bleach materials being especially preferred according to the present invention.

In an embodiment, the composition does not comprise bleach (and preferably does not comprise a bleach activator or bleach catalyst either) in the same liquid or gel phase as the PEI.

Other Ingredients

The skilled person will be aware of the kinds of ingredients needed to form effective ADW (automatic dishwashing) detergent compositions. The detergent compositions may comprise any other suitable ingredients known in the art.

For example, the detergent compositions may include enzymes. It is preferred that the enzyme is selected from proteases, lipases, amylases, cellulases and peroxidases, with proteases and amylases, especially proteases being most preferred. It is most preferred that protease and/or amylase enzymes are included in the compositions according to the invention as such enzymes are especially effective in dishwashing detergent compositions. Any suitable species of these enzymes may be used as desired. More than one species may be used.

The ADW detergent compositions may comprise one or more additional anti-corrosion agents. These anti-corrosion agents may provide further benefits against corrosion of glass and/or metal and the term encompasses agents that are intended to prevent or reduce the tarnishing of non-ferrous metals, in particular of silver and copper.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, bismuth, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of MnSO4, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, Zinc acetate, zinc sulphate and $Ce(NO_3)_3$. Any suitable source of multivalent ions may be used, with the source preferably being chosen from sulphates, carbonates, acetates, gluconates and metal-protein compounds. Zinc salts are especially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included. However, it is preferred that they are present in an total amount of from 0.01% by weight to 5% by weight, preferably 0.05% by weight to 3% by weight, more preferably 0.1% by weight to 2.5% by weight, such as 0.2% by weight to 2% by weight based on the total weight.

Polymers intended to improve the cleaning performance of the detergent compositions may also be included therein. For example sulphonated polymers may be used. Preferred examples include copolymers of $CH2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy) propanesulphonic acid, 2-methyl-2-propenen-1-sulphonic acid, styrenesul phonic acid, vinylsulphonic acid, 3-sulphopropyl acrylate, 3-sulphopropylmethacrylate, sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in an amount of at least 0.1% by weight, preferably at least 0.5% by weight, more preferably at least 1% by weight, and most preferably at least 3% by weight, up to 40% by weight, preferably up to 25% by weight, more preferably up to 15% by weight, and most preferably up to 10% by weight.

The detergent composition may also comprise one or more foam control agents. Suitable foam control agents for this purpose are all those conventionally used in this field, such as, for example, silicones and their derivatives and paraffin oil. The foam control agents are preferably present in amounts of 0.5% by weight or less.

The detergent compositions may also comprise minor, conventional, amounts of preservatives, fragrance etc.

pH

The ADW detergent compositions may also comprise a source of acidity or a source of alkalinity, to obtain the desired pH, on dissolution, especially if the composition is to be used in an automatic dishwashing application. A source of acidity may suitably be any suitable acidic compound for example a polycarboxylic acid. For example a source of alkalinity may be a carbonate or bicarbonate (such as the alkali metal or alkaline earth metal salts). A source of alkalinity may suitably be any suitable basic compound for example any salt of a strong base and a weak acid. When an alkaline composition is desired silicates are amongst the suitable sources of alkalinity. Preferred silicates are sodium silicates such as sodium disilicate, sodium metasilicate and crystalline phyllosilicates. In an embodiment, the composition is free of silicates.

In an embodiment, the composition has a pH between 6 and 13, between 6.5 and 12, between 7 and 11 or between 8 and 10.

The invention is further described with reference to the following non-limiting examples. Further examples within the scope of the invention will be apparent to the person skilled in the art.

EXAMPLES

Example 1

A three phase monodose composition, housed in a three-chambered PVOH capsule was prepared.

Powder formula 1 in compartment 1, dosage 11 g:

| | |
|---|---|
| MGDA | 25% |
| Sodium carbonate | 30% |
| Sodium percarbonate | 20% |
| Citric acid | 10% |
| Solid surfactant | 15% |

Powder formula 2 in compartment 3, dosage 1.3 g:

| | |
|---|---|
| Bleach Activator (TAED) | 25% |
| sodium carbonate | 25% |
| Cobuilders (Polyacrylates, Phosphonates) | 22% |
| Protease | 23% |
| Amylase | 5% |

Gel with glass protection agent, dosage 1.8 g:

| | |
|---|---|
| Glycerin | 90.6% |
| Gelatin | 6% |
| Lupasol ® FG (PEI, molecular weight 800) | 0.4% |
| Water + Dye | 3% |

Total PEI content: 7.6 mg per unit dose.

Example 2

Phosphate containing three-part composition in a three-chambered PVOH pouch.

Powder formula 1-16 grams

| | |
|---|---|
| STPP | 48.70% |
| Sodium carbonate | 16.00% |
| Trisodium citrate | 22.00% |
| Benzotriazol | 0.40% |
| HEDP | 0.30% |
| Protease | 1.50% |
| Amylase | 1.00% |
| 1,2 Propylenedigylcol | 1.00% |
| Sulphonated polymer | 5.00% |

Powder 2-1.3 grams

| | |
|---|---|
| Sodium percarbonate | 100% |

Gel composition—2.5 grams

| | |
|---|---|
| Glycerin | 47.0% |
| Gelatin | 3% |
| TAED | 49.7% |
| Lupasol ® FG (PEI) | 0.2% |
| Dye | 0.1% |

Total PEI content: 5 mg per unit dose.

Example compositions 1 and 2 were both tested according to the glass corrosion test methodology as set out in WO 2010/020765, pages 14-16. Both gave results at least equivalent to the results for Example 3 on Table 5a and 5b of WO 2010/020765, which is a solid formulation. The results for the compositions of the present invention were consistent and reliable when the compositions were produced on an industrial scale.

The invention claimed is:

1. An automatic dishwasher detergent composition comprising:

a polyethyleneimine; and an anionic surfactant, wherein the polyethyleneimine is contained within one or both a gel and liquid phase of the composition, wherein the amount of the polyethyleneimine is less than 0.5% by weight of the composition, wherein the anionic surfactant is no more than 4% by weight of the composition, wherein the gel and/or liquid phase contains no more than 5% water by weight of the gel and/or liquid phase, and wherein the composition is contained within a water soluble film or container.

2. The composition as claimed in claim 1, wherein the composition comprises less than 0.25% by weight of the polyethyleneimine.

3. The composition as claimed in claim 1, wherein the composition consists of the gel phase.

4. The composition as claimed in claim 1, wherein the composition comprises at least two separate phases.

5. The composition as claimed in claim 4, wherein one of the at least one two separate phases is the solid phase selected from the group consisting of powder, granules, and a compressed solid.

6. The composition as claimed in claim 1, wherein the composition comprises at least 10% by weight builder.

7. The composition as claimed in claim 1, wherein the composition comprises one or more of protease, amylase, and bleach.

8. The composition as claimed in claim 1, wherein the polyethyleneimine has a molecular weight between 100 and 2500.

9. The composition as claimed in claim 1, wherein the polyethyleneimine is a liquid ingredient at room temperature.

10. A product comprising the composition as claimed in claim 1, which is in a unit dose form.

11. A method of automatic dishwashing comprising:

supplying a composition as claimed in claim 1 to an automatic dishwasher; and releasing the composition into a wash cycle of the automatic dishwasher.

12. The method as claimed in claim 11 further comprising washing glassware in the automatic dishwasher.

13. The composition as claimed in claim 1, wherein the composition comprises between 0.0001 and 0.0025% by weight of the polyethyleneimine.

14. The composition as claimed in claim 1, wherein the composition consists of the liquid phase.

15. The composition as claimed in claim 1, wherein the gel or liquid phase which comprises the polyethyleneimine comprises at least 10% surfactant by weight of the gel or liquid phase.

16. The composition as claimed in claim 1, wherein the polyethyleneimine has a molecular weight between 700 and 900.

17. The composition as claimed in claim 1, wherein the polyethyleneimine contains no alkoxylate groups.

18. The composition as claimed in claim 1, wherein the polyethyleneimine is homopolymeric.

19. The composition as claimed in claim 1, wherein the polyethyleneimine contains primary, secondary and tertiary amine groups, and has a ratio of primary to secondary amine groups between 1:0.5 and 1:1.

20. An automatic dishwasher detergent composition comprising:

a polyethyleneimine;

water; and an anionic surfactant, wherein the polyethyleneimine is contained within one or both a gel and liquid phase of the composition, wherein the amount of the polyethyleneimine is less than 0.5% by weight of the composition, wherein the composition comprises no more than 4% by weight of the anionic surfactant, wherein the water is present in one or both the gel and liquid phase in an amount of no more than 5% by weight of the gel and/or liquid phase, and wherein the composition is contained within a water soluble film or container.

* * * * *